US006513440B1

(12) United States Patent
Huard et al.

(10) Patent No.: US 6,513,440 B1
(45) Date of Patent: Feb. 4, 2003

(54) INCLINED CABLE CAR STATION

(75) Inventors: Jean Paul Huard, Jorioz (FR); Jean Souchal, Grenoble (FR)

(73) Assignee: Pomagalski SA (FR)

( * ) Notice: Subject to any disclaimer, the term of this patent is extended or adjusted under 35 U.S.C. 154(b) by 0 days.

(21) Appl. No.: 09/644,815

(22) Filed: Aug. 24, 2000

(30) Foreign Application Priority Data

Aug. 25, 1999 (FR) ..... 99 10781
Apr. 7, 2000 (FR) ..... 00 04498

(51) Int. Cl.[7] ..... B61B 1/00
(52) U.S. Cl. ..... 104/27; 104/27
(58) Field of Search ..... 104/27, 28, 29, 104/30, 31, 173.1, 173.2, 178, 179; 414/314, 75, 324

(56) References Cited

U.S. PATENT DOCUMENTS 2,677,331 A * 5/1954 Hauseman ..... 104/173.1
3,875,867 A * 4/1975 Geyer ..... 104/173.2
4,003,314 A * 1/1977 Pearson ..... 104/1 R
4,049,999 A * 9/1977 Thibaudon ..... 318/305
4,484,739 A * 11/1984 Kreinbihl et al. ..... 104/70
4,530,632 A * 7/1985 Sela ..... 414/35
4,641,585 A * 2/1987 Tarassoff ..... 104/173.2
4,802,416 A * 2/1989 Meindl ..... 104/192
5,172,640 A * 12/1992 Cathiard ..... 104/173.2

FOREIGN PATENT DOCUMENTS

EP 2 333 684 7/1977
EP 0 125 967 11/1984

* cited by examiner

*Primary Examiner*—S. Joseph Morano
*Assistant Examiner*—Frantz F. Jules
(74) *Attorney, Agent, or Firm*—Parkhurst & Wendel, L.L.P.

(57) ABSTRACT

A disengageable cable car station includes a support structure (1) extending above the ground (2) for guiding and driving the cable (3) supporting the vehicles transporting the passengers and for guiding and supporting the vehicles which have been disengaged from the cable (3). The cable (3) forms a loop for bringing the vehicles to the station entrance. A device is provided for moving the disengaged vehicles as far as a passenger disembarkation and embarkation area (5). The structure (1, 1*a*, 1*b*) supporting, guiding and driving the cable (3) and supporting the disengaged vehicles is elongated in the direction of the cable (3) and is inclined in order to guide the cable (3) and move the disengaged vehicles along a slope in order to decelerate or accelerate the vehicles. The entire station support structure (1) is inclined.

5 Claims, 3 Drawing Sheets

INCLINED CABLE CAR STATION

TECHNICAL FIELD OF THE INVENTION

The present invention concerns a disengageable cable car station comprising a support structure extending above the ground for guiding and driving the cable supporting the vehicles transporting the passengers.

BACKGROUND OF THE INVENTION

FIGS. 1, 2, 3 are respectively a view in elevation, a plan view and a view in the direction of the arrow F in FIG. 1 of a known design of a cable car terminal station.

As shown by the above figures, the disengageable cable car station comprises a support structure 1 extending above the ground 2 for guiding and driving the cable 3 supporting the vehicles 4 transporting the passengers, and for guiding and supporting the vehicles which have been disconnected from the cable 3.

The cable 3 forms a loop 3*a* (see FIG. 2) for bringing the vehicles to the entrance to the station; the vehicles 4 are then hauled as far as the area 5 where the passengers disembark and embark.

The structure 1 for supporting, guiding and driving the cable 3 and supporting the disengaged vehicles is elongated in the direction of the cable 3 and is inclined in order to guide the cable 3 and move the disengaged vehicles along a slope in order to decelerate or accelerate the vehicles after their departure or before their arrival in the embarkation or disembarkation area.

The gravity exerted on the vehicles associated with the above slope is combined with a system for hauling the vehicle in the station. The sum of the forces available through this driving system and the above slope makes it possible to obtain the required acceleration or deceleration of the vehicle.

In order to limit the length and the forces of the driving system, as great a slope as possible is produced so that in service, in normal running, the gravity associated with this slope plays an important part in the acceleration or deceleration forces.

The angle of the slope on which the disengaged vehicles move is limited by the fact that the driving system must make it possible to drive the vehicles situated in the area of this slope whilst they are at rest (in particular during the start-up phase).

The fact that the known stations have a support structure which is horizontal in the passenger disembarkation and embarkation area and inclined in the acceleration and deceleration area complicates the design of the stations and increases their construction cost.

The aim of the present invention is to remedy this drawback.

SUMMARY OF THE INVENTION

According to the invention, the station is characterised in that the entire support structure of the station is inclined.

Preferably, the entire station is inclined.

The idea of inclining the entire station is not natural since inclining the constant-speed travel area induces forces which are opposed to the movement of the vehicles.

The advantage of this inclination lies in the fact that it makes it possible to construct stations in advance, without being concerned whether they will be installed horizontally or with "gravity". According to what is required by the characteristics of the equipment and without having recourse to articulations in the middle of the station, articulations which are complex to execute.

To add to this advantage, it is of course possible to construct the roofs parallel to the structure, which will then be installed horizontally or with gravity.

According to the invention, it is possible to provide stations with "variable gravity"; too much gravity causes difficulty on restarting (in order to restart vehicles positioned in the deceleration area for example, it is necessary both to generate the movement and to mitigate the force related to the slope of the deceleration track).

In fact, it is possible to vary the slope of the entire station by means, for example, of jacks and in addition to vary the slope of the station according to the speed of operation of the equipment.

Other particularities and advantages of the invention will also appear in the following description.

BRIEF DESCRIPTION OF THE DRAWINGS

In the accompanying drawings given by way of non-limitative examples.

DETAILED DESCRIPTION

Figure 1:
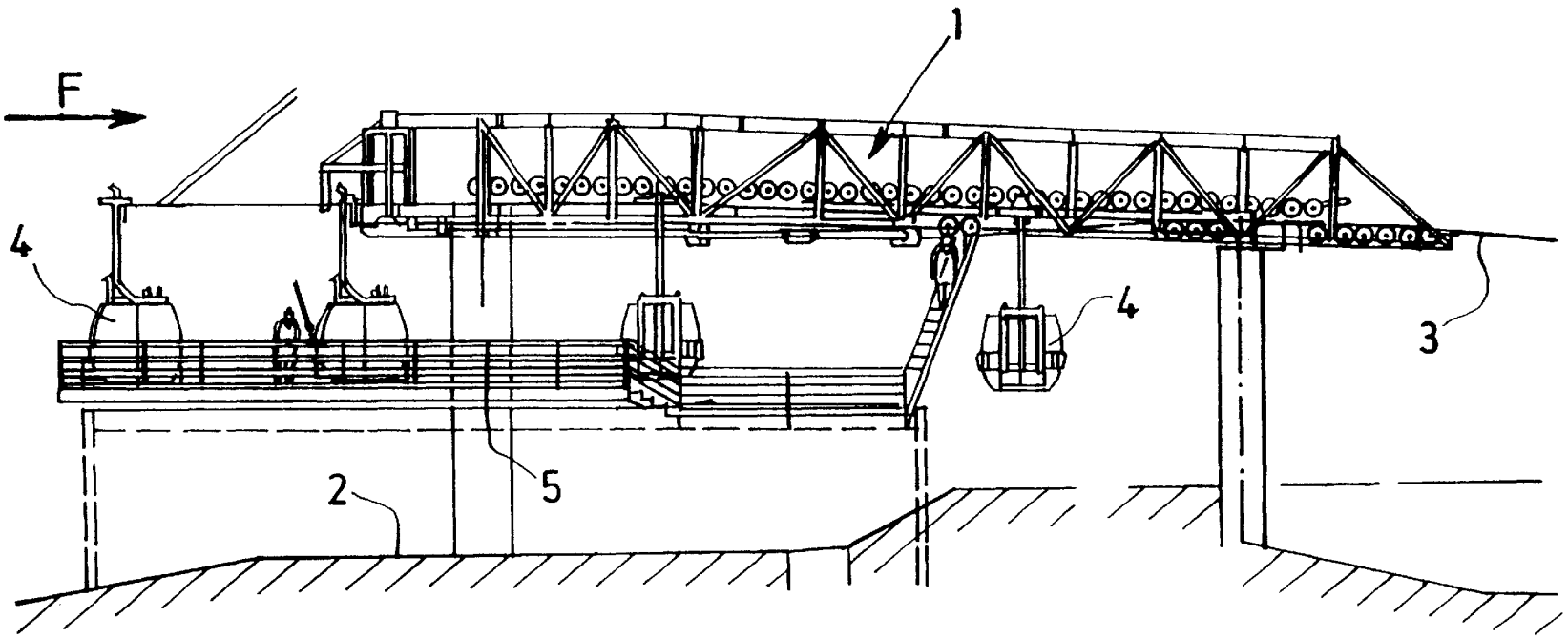
FIG.1 PRIOR ART
FIG. 1, 2, 3 are, respectively, a view in elevation, a plan view and a view in the direction of the arrow F in FIG. 1 of a known design of a cable car terminal station.
Figure 2:
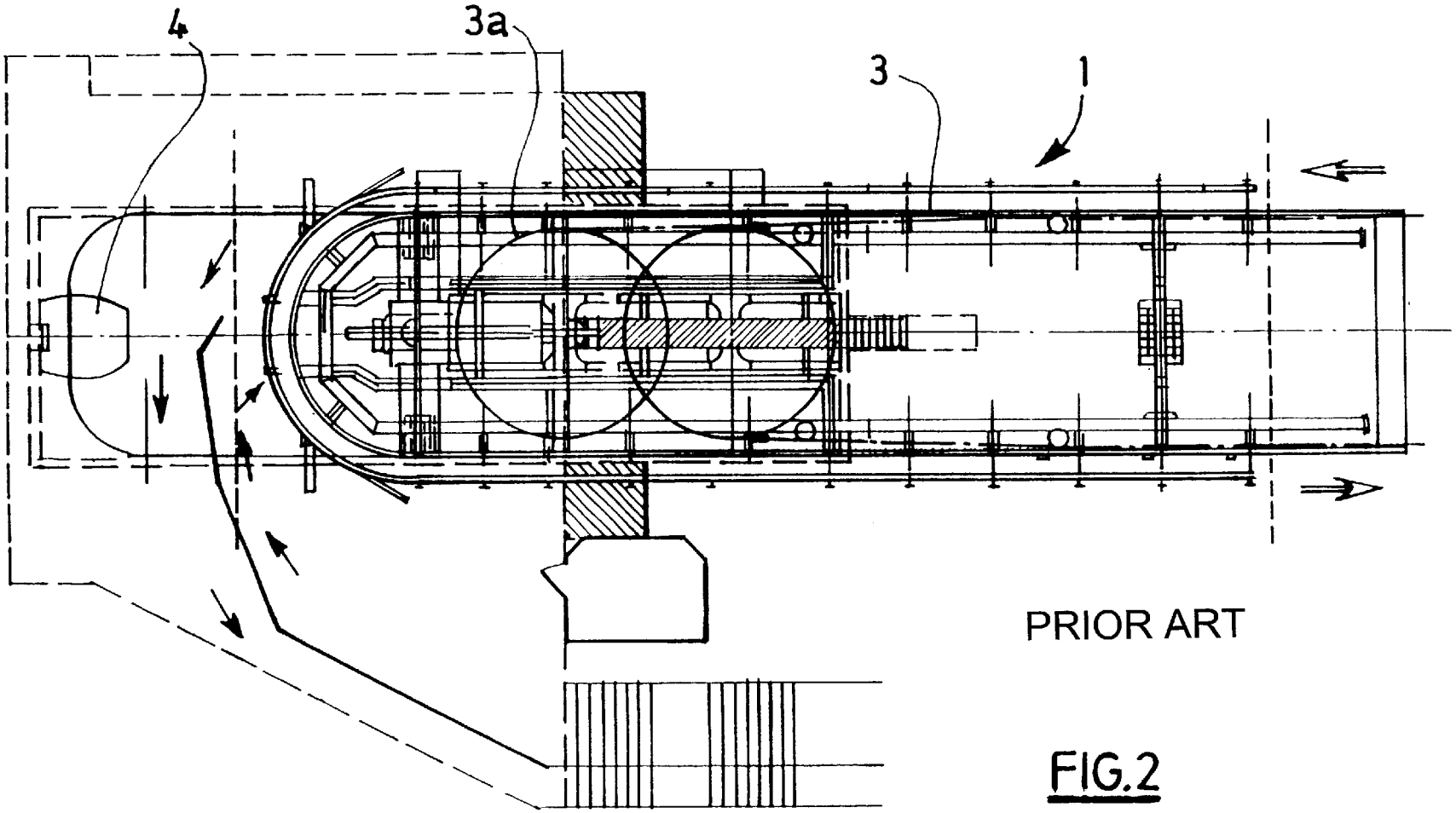
PRIOR ART FIG.2
Figure 3:
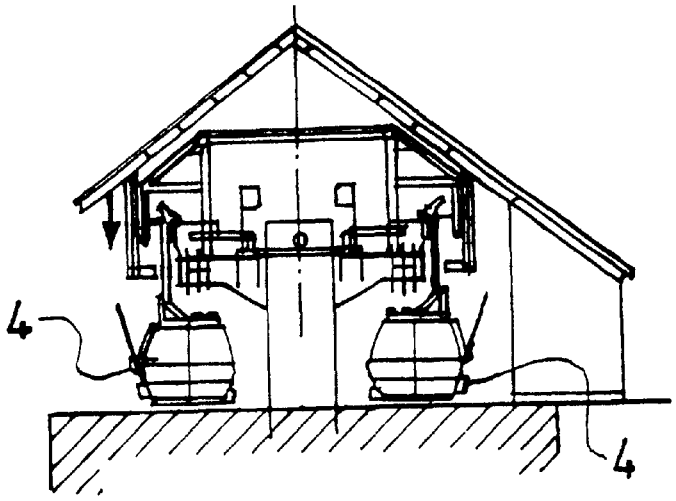
FIG.3 PRIOR ART
Figure 4:
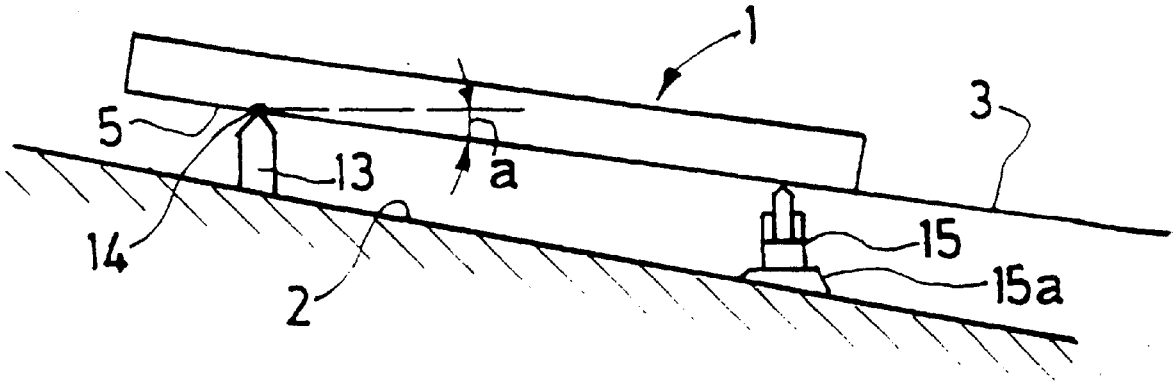
FIG. 4 is a schematic view in elevation of a cable car station according to the invention.

In the embodiment according to FIG. 4 of the cable car station, the entire support structure 1 is inclined.

In this embodiment, the support structure 1 is supported close to its end corresponding to the embarkation area 5 by a pillar 13, the top end of which is connected to the support structure 1 by a pivot 14.

The base of the pillar 13 is anchored in the ground 2.

The support structure 1 is supported close to its end opposite to the embarkation area 5 by means 15 adjustable for height in order to vary the angle a of the slope of this structure 1.

The means adjustable in height 15 can consist of a hydraulic or electric jack, whose base 15*a* is anchored in the ground 2.

The adjustment of the angle a of the slope of the structure 1 makes it possible to adjust the slope of movement of the disengaged vehicles.

The increase in the slope has the effect of increasing the force resulting from the slope and the gravity exerted on the vehicles.

This force is added to the force produced by the driving system and then increases the speed of the vehicles.

Thus it is advantageous, when the vehicles start up, to have a slight or zero slope, and then to next increase the slope by acting on the jack 15 when the speed of the vehicles increases.

Naturally, the invention is not limited to the example embodiments which have just been disclosed, and many modifications can be made to these without for all that departing from the scope of the invention.

What is claimed is:

1. A disengageable cable car station comprising a support structure (1), extending above the ground (2), for guiding and driving a cable (3) supporting vehicles (4) transporting passengers, and for guiding and supporting the vehicles which have been disengaged from the cable (3), the cable (3) forming a loop for bringing the vehicles (4) to the entrance to the station, means then being provided for moving the disengaged vehicles as far as a passenger disembarkation and embarkation area (5), the structure (1) for supporting, guiding and driving the cable (3) and supporting the disengaged vehicles being elongated in the direction of the cable (3) and being inclined in order to guide the cable (3) and move the disengaged vehicles along a slope in order to decelerate or accelerate the disengaged vehicles, wherein the entire station support structure in inclined at the same inclination and without articulation between the inclined portions thereof for guiding and driving the cable (3) supporting the vehicles (4) transporting passengers, and for guiding and supporting vehicles which have been disengaged from the cable (3).

2. A station according to claim 1, characterised in that the entire station is inclined.

3. A station according to claim 1, characterised in that the inclination is variable.

4. A station according to claim 1, characterised in that the support structure (1) is supported close to its end corresponding to the embarkation area (5) by a pillar (13) whose end is connected to the support structure (1) by a pivot (14), this structure (1) being supported close to its end opposite to the embarkation are a (5) by means (15) adjustable for height in order to vary the slope of the said structure.

5. A station according to claim 4, characterised in that the said means (15) adjustable for height consist of a hydraulic or electric jack.

* * * * *